US007172678B2

(12) United States Patent
Canfield et al.

(10) Patent No.: US 7,172,678 B2
(45) Date of Patent: Feb. 6, 2007

(54) PROCESS OF MAKING COMPOSITE SHEET MATERIAL

(75) Inventors: V. Robert Canfield, Martinsville, NJ (US); Robson F. Storey, Hattiesburg, MS (US); Betty C. Roberts, Chester, SC (US)

(73) Assignee: GAF Materials Corporation, Wilmington, DE (US)

( * ) Notice: Subject to any disclaimer, the term of this patent is extended or adjusted under 35 U.S.C. 154(b) by 210 days.

(21) Appl. No.: 10/463,921

(22) Filed: Jun. 17, 2003

(65) Prior Publication Data

US 2004/0256068 A1 Dec. 23, 2004

(51) Int. Cl.
*D21H 13/40* (2006.01)
*B32B 17/02* (2006.01)

(52) U.S. Cl. ..... 162/156; 162/166; 162/169; 162/179

(58) Field of Classification Search ..... 162/145, 162/179, 156, 164.1, 169, 165, 166; 428/392, 428/299.4; 442/331
See application file for complete search history.

(56) References Cited

U.S. PATENT DOCUMENTS

| | | | | |
|---|---|---|---|---|
| 4,135,029 | A | 1/1979 | Pfeffer | |
| 4,178,203 | A | 12/1979 | Chakrabarti | |
| 4,430,158 | A | 2/1984 | Jackey et al. | |
| 4,536,446 | A * | 8/1985 | Hsu et al. | 428/392 |
| 4,810,576 | A * | 3/1989 | Gaa et al. | 428/391 |
| 5,910,458 | A * | 6/1999 | Beer et al. | 442/367 |
| 6,121,398 | A * | 9/2000 | Wool et al. | 526/238.1 |

* cited by examiner

*Primary Examiner*—Eric Hug
*Assistant Examiner*—Carlos Lopez
(74) *Attorney, Agent, or Firm*—William J. Davis; Walter Katz

(57) ABSTRACT

A composite sheet material, useful as a component of roofing shingles, and a process of making same, which includes a glass fiber web bound with a thermosetting resin which includes a fatty acid amide having the structural formula $RCOONH_2$, where R is a $C_8$–$C_{25}$ alkyl.

7 Claims, No Drawings

PROCESS OF MAKING COMPOSITE SHEET MATERIAL

BACKGROUND OF THE DISCLOSURE

1. Field of the Invention

The present invention is directed to a composite sheet material useful as a component for asphalt shingles, which provides shingles having improved tear strength, without compromise of tensile and flextural strength.

2. Description of the Prior Art

High strength, uniform thin sheets or mats of glass fibers have become very important in the building materials industry. Probably the best example of the use of this type of material is in roofing shingles. The art is replete with descriptions of glass fiber mats and methods of making those mats having improved strength characteristics formed of glass fibers and made commercially by a wet-laid process.

An interesting description of the development of this process is set forth in U.S. Pat. No. 4,135,029. Glass fiber mats made by the wet-laid process are formed by combining glass fibers held together by a binder material. Although binders useful in this application include urea-formaldehyde resins, phenolic resins, bone glue, polyvinyl alcohols, acrylic resins and polyvinyl acetates, urea-formaldehyde resins are preferred due to their low cost.

Earlier developments of glass fiber mats focused upon improvement in tensile strength. For example, U.S. Pat. No. 4,178,203 describes the addition of an anionic surfactant having at least one hydrophobic segment containing from 8 to 50 carbon atoms and an anionic segment which may be carboxy, sulfate ester, phosphate ester, sulfonic acid or phosphonic acid. Alternatively, the anionic surfactant may be a soap selected from a sodium, a potassium, an ammonium and an alkylammonium salt of a $C_{10}$–$C_{20}$ fatty acid.

U.S. Pat. No. 4,430,158 provides improved tensile strength to a sized glass fiber mat by adding an anionic surfactant which contains hydrophobic segments containing from 8 to 30 carbon atoms and anionic segments which may be carboxy, sulfate ester, phosphate ester, sulfonic acid and phosphonic acid.

Yet a further means of improving tensile strength of glass fiber mats employed as roofing shingles is taught in U.S. Pat. No. 4,542,068 which discloses a method of making a glass fiber mat in which an alkoxylated alkyl amine having the formula

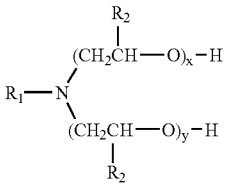

is added to a binder composition which comprises urea-formaldehyde and in which glass fibers are dispersed in a wet-laid process.

Although these and other methods have been devised for improving tensile strength of glass mat fibers, these improvements do not address a significant problem associated with the use of glass mats employed in roof shingles.

Those skilled in the art are aware that a major fabrication difficulty in the production of roofing shingles using glass fibers mats is meeting the ASTM standard for tear resistance, which is required for ASTM certification. Oftentimes, means utilized to increase tensile strength of glass fiber mats, for example, the addition of latex, specifically a styrene-butadiene latex copolymer, as described in U.S. Pat. No. 4,917,764, result in reduced tear strength of shingles made from such mat.

The tear resistance is the force required to rip a sample of material having a standard geometry. Roofing shingles are tested for tear resistance in accordance with ASTM Standard Test Procedure D 1922. This test involves the use of an Elmendorf apparatus. In certain applications, roofing shingles must conform to ASTM Standard D 3462, which requires a tear strength of 16.7 N (1704 grams force (gf)). Ordinary roofing shingles often fall short of this minimum tear strength.

The art has previously overcome this deficiency in tear strength by raising the weight of the glass mat and the asphalt disposed thereon. However, this expedient is costly.

The above remarks establish the need in the art for a new composite glass fiber mat sheet utilizable as a component of a roofing shingle, and a method of preparing that composite sheet, which provides shingles having improved tear resistance without seriously adversely affecting tensile strength.

BRIEF SUMMARY OF THE INVENTION

A new composite sheet, useful as a mat for a roofing shingle, has now been discovered which provides improved tear strength without significantly adversely affecting tensile strength.

In accordance with the present invention, a composite sheet useful as a mat for a roofing shingle is provided. The composite sheet material comprises a resin binder laden glass fiber mat having a fatty acid amide of the structural formula $RCOONH_2$, where R is a $C_8$–$C_{25}$ alkyl incorporated therein. The fatty acid amide is incorporated by spraying a fatty acid amide emulsion to surface coat the resin laden glass fiber mat or by distributing the fatty acid amide emulsion throughout the glass mat by mixing the fatty acid amide emulsion with the resin binder and applying the resin binder to the randomly dispersed glass fibers.

In further accordance with the present invention, a process of making a glass fiber mat is provided. In this process, glass fibers are dispersed in an aqueous dispersant. The dispersion is strained to form a glass fiber mat. The glass fiber mat is thereupon contacted with an aqueous dispersion of a resin binder to form a resin binder laden glass fiber mat. The surface of the glass fiber laden with resin binder is then treated with a dispersion of an fatty acid amide having the structural formula $RCOONH_2$, where R is a $C_8$–$C_{25}$ alkyl. Following surface treatment, the structure is then cured to form a composite sheet having a surface coat of fatty acid amide and including randomly dispersed glass fibers that are bound by a resin binder. Alternatively, the fatty acid amide emulsion may be mixed with the resin binder and distributed throughout the glass fiber mat.

DETAILED DESCRIPTION

The composite sheet of the present invention includes a plurality of randomly dispersed glass fibers that are bound with a resin binder and then surface treated with a fatty acid amide having the structural formula $RCOONH_2$, where R is a $C_8$–$C_{25}$ alkyl. More preferably, R is a $C_{10}$–$C_{22}$ alkyl. Still more preferably, R is a $C_{17}$–$C_{20}$ alkyl. Even still more preferably, R is a $C_{17}$–$C_{18}$ alkyl. Most preferably, the fatty acid amide is stearamide or tallowamide. Tallowamide is commercially available as Armid® HT having the structural formula $RCOONH_2$, where R=hydrogenated tallowalkyl, and having a chain length of $C_{16}$–$C_{18}$. Armid® HT is available from Akzo Nobel Inc. Alternatively, the fatty acid amide emulsion may be mixed with the resin binder and therefore distributed throughout the glass fiber mat as the resin is applied to the randomly dispersed glass fibers. The fatty acid amide may be partially or fully hydrogenated using techniques well known to those skilled in the art. The degree of hydrogenation is not believed to be important to the present invention.

The resin binder employed in the composite sheet of the present invention is preferably a thermosetting resin such as urea-formaldehyde resin, a phenol-formaldehyde resin or other phenolic resin. Of these, urea-formaldehyde resins are preferred as the resin binder. Alternatively, the resin binder employed in the composite sheet of the present invention may include thermoplastic resins such as polyvinyl alcohol, polyvinyl acetate, acrylic resins, and bone glue.

In a preferred embodiment, a polymeric modifier is optionally added to the binder. Preferred polymeric modifiers, include styrene-maleic acid copolymers, styrene-butadiene copolymers, acrylic polymers, ethylene vinyl acetate, and polyvinyl acetate. In a preferred embodiment wherein a polymeric modifier is present, it is present in a concentration in the range of between about 1% and about 20%, said percentages being by weight of solids, based on the total weight of the resin binder solids.

The fatty acid amide constituent of the thermosetting resin matrix of the present invention is present in a concentration in the range of between about 0.25% and about 5%, said percentages being by weight, based on the total weight of the resin binder solids. Preferably, the fatty acid amide is present in a concentration in the range of between about 0.35% and about 3% by weight. More preferably, the fatty acid amide is present in a concentration in the range of between about 0.4% and about 2% by weight. Still more preferably, the fatty acid amide comprises about 0.5% to about 1% by weight of the resin binder.

In another embodiment of the present invention, a process of making a glass mat is provided. In this process, glass fibers are dispersed in an aqueous dispersion. In a preferred embodiment, the aqueous dispersant is water. The dispersion is strained to form a glass fiber web. In a preferred embodiment, the straining step is accomplished using a moving wire or screen.

The glass-fiber web is then bound with an aqueous dispersion of a resin binder. The resin binder is predominantly a thermosetting resin. For example, a urea-formaldehyde resin, a phenol-formaldehyde resin, or other phenolic resin may be used as the thermosetting resin. Preferably the other phenolic resin is other than phenol formaldehyde resin. Of these thermosetting resins, urea-formaldehyde is particularly preferred. The resin binder may optionally contain a polymeric modifier, such as carboxylated styrene-butadiene copolymer. Contact of the glass fiber web with the resin binder preferably occurs by passing the glass fiber web beneath a flowing curtain of binder, where the excess binder is withdrawn through vacuum slots positioned beneath the glass fiber web.

The resin laden glass mat is then surface treated with a fatty acid amide, as defined above, in a concentration within the ranges defined above. In a preferred embodiment, the surface treatment step is accomplished by spraying a dispersion of the fatty acid amide onto the wet resin laden glass fiber mat. Alternatively, the fatty acid amide emulsion may be incorporated into the binder.

The dispersion of fatty acid amide comprises a fatty acid amide, water, and a dispersion agent. The dispersion agent is a cationic surfactant, such as an ethoxylated fatty alkyl amine having a chain length of about $C_8$ to about $C_{18}$. The dispersion of fatty acid amide is prepared using a high-speed mixer having a high shear rotor and stator mixer, such as a Ross Model 100 L mixer with disintegrator head. The dispersion is preferably mixed at a rate of about 5000 rpm.

The thermosetting resin-laden glass mat is cured by heating. In a preferred embodiment, curing is effected at atmospheric pressure in a thru air oven maintained at a temperature in the range of between about 250° C. and about 325° C. for a period of about 5 to about 20 seconds. More preferably, curing occurs at a temperature in the range of between about 270° C. and 300° C. for a period of about 10 to about 15 seconds.

The glass mats of the present invention which have been treated with the fatty acid amide are then used in the conventional manner known to those skilled in the roofing art.

The following examples are given to illustrate the scope of the present invention. Because these examples are given for illustrative purposes only, the invention should not be deemed limited thereto.

COMPARATIVE EXAMPLE 1

Glass fibers were first randomly dispersed in water. The dispersion was then strained so as to dispose the dispersion over a moving screen.

Once strained, the glass fiber web was then dipped in a resin binder dispersion containing urea formaldehyde in water. The resin binder dispersion further included a polymeric modifier, carboxylated styrene-butadiene copolymer, incorporated in an amount of 1% by weight, based on the total polymeric solids content of the dispersion, where the remainder of the polymer content of the dispersion was urea formaldehyde. The application of the resin binder bound the glass fibers to form a glass fiber mat.

The resin-laden glass mat was then heated in an air oven, maintained at atmospheric pressure, at 300° C. for a period of 13 seconds.

The thus cured mat was then coated with a mix of 68% Minneapolis Superior filler and 32% Baltimore coating asphalt. The samples were coated to a target weight of 57 lbs./100 $ft^2$.

About 8–9 samples of asphalt roofing shinglets were tested and the statistically average results of these samples tested for tear and tensile strength are provided in Table 1. Shinglets differ from commercial shingles in that they have no granules on one side and no sand on the other as do shingles, and the glass mat is centered between two asphalt coatings of similar thickness, while in commercial shingles the coating on one side is much thicker than on the other.

An analysis of the tear strength of the samples was obtained by following the procedures for measuring the tear strength of shingles as indicated by ASTM standard D3462.

A tensile test was conducted using a constant rate of elongation machine for evaluating the mechanical properties of materials, available from Instron, Corp. The samples included the above prepared test shingles cut into 1" wide test strips having a 4" gage length. The constant rate of elongation machine was operated at a rate of 1" per minute.

EXAMPLE 1

Comparative Example 1 was reproduced with the additional step of treating the surface of the resin binder laden glass fiber mat with a fatty acid amide. The fatty acid amide was applied following the application of the resin binder by spraying Armid® HT atop the glass fiber mat in a concentration of 0.5%, by weight, based on the weight of the thermosetting urea formaldehyde binder, which includes 1% carboxylated styrene-butadiene copolymer. Armid® HT, which is hydrogenated tallowalkylamide (tallowamide), was sprayed onto the matrix-laden glass fiber web as a cationic dispersion. The Armid® HT was dispersed in hot water including an ethoxylated fatty alkyl amine surfactant having a chain length ranging from $C_8$–$C_{18}$. The cationic dispersion was mixed using a high shear rotor and strator mixer and operated at 5,000 rpms. The resultant dispersion had a particle size of 15 μm or less.

About 8–9 asphalt shinglets were produced in Example 1. These samples were identically tested as in Comparative Example 1. The results of these tests are reported in Table 1. Shinglets differ from commercial shingles in that they have no granules on one side and no sand on the other as do shingles, and the glass mat is centered between two asphalt coatings of similar thickness, while in commercial shingles the coating on one side is much thicker than on the other.

TABLE 1

| Asphalt Roof Shinglets of | Tear Strength[1] gram (f) | Standard Deviation | % Increase | Tensile Strength lb(f)/in | % Decrease |
|---|---|---|---|---|---|
| Comparative Example 1 | 1028 | 153 | — | 82 | |
| Example 1 | 1391 | 325 | 35 | 78 | 18 |

[1]Based on testing in accordance with ASTM D 3462

COMPARATIVE EXAMPLE 2

Four glass fiber mats were prepared and asphalt coated in accordance with the procedure set forth in Comparative Example 1.

The asphalt roofing shinglets prepared in accordance with this procedure were tested to determine tear strength and tensile strength. An analysis of the tear strength of the samples was obtained by following the procedures for measuring the tear strength of shingles as indicated by ASTM standard D3462.

A tensile test was conducted using a constant rate of elongation machine for evaluating the mechanical properties of materials, available from Instron, Corp. The samples included the above prepared test shingles cut into 1" wide test strips having a 4" gage length. The constant rate of elongation machine was operated at a rate of 1" per minute. These results are summarized in Table 2.

EXAMPLE 2

Comparative Example 2 was reproduced with the additional step of spraying the thermosetting resin-laden glass fiber mat with 1% by weight Armid® HT, based on the total polymeric weight of the thermosetting resin matrix. The 1% by weight Armid® HT dispersion was applied as a dispersion in which Armid® HT was dispersed in hot water including an ethoxylated fatty alkyl amine surfactant having a chain length ranging from $C_8$–$C_{18}$. The cationic dispersion was mixed using a high shear rotor and strator mixer operated at 5,000 rpms. The resultant dispersion had a particle size of 10 μm or less.

About 8–9 resultant glass fiber mats, which were each 92 g/m$^2$, were identically tested as in Comparative Example 2. The results of these tests are reported in Table 2.

EXAMPLE 3

Example 2 was identically reproduced but for the dispersant utilized in the 0.1% Armid® HT dispersion. In this example, the dispersant was ethoxylated fatty alkyl amine surfactant having a chain length ranging from $C_8$–$C_{18}$, produced by Prochem Chemicals Inc.

The resultant glass mats was treated for tear strength in accordance with ASTM Standard Test Procedure D 3462.

The results of these examples, encompassing 8–9 samples, are summarized in Table 2.

TABLE 2

| Samples of | Tear Strength, gm(f) | Stand. Deviation | Tear strength increase % | Tensile Str. lb(f)/in$^2$ |
|---|---|---|---|---|
| Comparative Ex 2 | 1017 | 118 | — | 73.7 |
| Example 2 | 1095 | 143 | 8 | 74.3 |
| Example 3 | 1106 | 158 | 9 | 74.0 |

SUMMARY OF THE RESULTS

The results summarized in Table 1 indicate that an increase in tear strength of approximately 35% is achieved by spraying a 0.5% by weight Armid® HT dispersion atop resin laden glass fiber mat prior to curing, when compared to similar prepared glass mat samples without being surface treated with the Armid® HT dispersion. The results summarized in Table 1 further indicate that there was a negligible change in the tensile strength of the samples surface treated with 0.5% by weight Armid® HT dispersion when compared to similarly prepared samples that were not surface treated using the Armid® HT dispersion.

The results summarized in Table 2 indicate that an increase in tear strength of approximately 7–8% is achieved by spraying a 1.0% by weight Armid® HT dispersion atop the resin laden glass fiber mat prior to curing, when compared to similar prepared glass mat samples without being surface treated with the Armid® HT dispersion. The results summarized in Table 2 further indicate that there was a negligible change in the tensile strength of the samples surface treated with 1.0% by weight Armid® HT dispersion when compared to similarly prepared samples that were not surface treated using the Armid® HT dispersion.

The above embodiments and examples are given above to illustrate the scope and spirit of the present invention. These embodiments and examples will make apparent, to those skilled in the art, other embodiments and examples. These other embodiments and examples are within the contemplation of the present invention. Therefore, the present invention should be limited only by the appended claims.

What is claimed is:

1. A process of making a composite sheet, which comprises the steps of dispersing glass fibers in an aqueous dispersant;

screening said glass fibers so that said dispersed glass fibers form a glass fiber mat;

contacting said glass fiber mat with a resin binder, wherein a resin binder laden glass fiber mat is formed;

adding a fatty acid amide to said resin binder laden glass fiber mat, said fatty acid amide present in a concentration in the range of between 0.25% and about 5% based on the total weight of said resin binder; and curing said composite sheet.

2. A process in accordance with claim 1 wherein said resin binder includes urea formaldehyde.

3. A process in accordance with claim 1 wherein said fatty acid amide has the structural formula $RCOONH_2$, where R is a $C_8$–$C_{25}$ alkyl.

4. A process in accordance with claim 1 wherein said composition sheet is cured at a temperature in the range of between about 270° C. and about 325° C., at atmospheric pressure, over a period of about 5 to about 15 seconds.

5. A process in accordance with claim 4 wherein said resin binder includes a polymeric modifier.

6. A process in accordance with claim 1 wherein said fatty acid amide is stearamide or tallowamide.

7. A process of making a composite sheet, which comprises the steps of:

dispersing glass fibers in an aqueous dispersant;

screening said glass fibers so that said dispersed glass fibers form a glass fiber mat;

contacting said glass fiber mat with a resin binder which includes a fatty acid amide to form a resin binder laden glass fiber mat, said fatty acid amide present in a concentration in the range of between 0.25% and about 5% based on the total weight of said resin binder; and curing said resin binder laden glass fiber mat.

* * * * *